US005269250A

United States Patent [19]

Daniels

[11] Patent Number: 5,269,250

[45] Date of Patent: Dec. 14, 1993

[54] METHOD AND APPARATUS FOR MOUNTING A CURVED PANEL TO A LANDING

[75] Inventor: Brian K. Daniels, Bradenton, Fla.

[73] Assignee: Aldon Industries, Inc., Bradenton, Fla.

[21] Appl. No.: 766,925

[22] Filed: Sep. 27, 1991

[51] Int. Cl.[5] ..... B63B 17/00

[52] U.S. Cl. ..... 114/361; 296/96.21; 114/343

[58] Field of Search ..... 114/343, 361, 356; 296/84.1, 93, 96.12, 96.21; D12/182

[56] References Cited

U.S. PATENT DOCUMENTS 3,016,548 1/1962 Taylor ..... 114/361

4,750,449 6/1988 Muhlberger ..... 114/361

4,966,092 10/1990 Illingworth ..... 114/356

OTHER PUBLICATIONS

Loxcreen Co. Inc. Die No. 5923 Actual Date unknown, but known to be yrs. prior to Jan. 1987.

*Primary Examiner*—Edwin L. Swinehart

[57] ABSTRACT

A method and apparatus for mounting a curved panel to a landing. The apparatus includes an elongated extrusion having in cross section a side portion coupled to a base portion. The extrusion is shaped along a curve, and the base portion angles away from the side portion to lie flat against the landing. The extrusion is secured through the base portion to the landing. The curved panel is secured to the side portion.

11 Claims, 3 Drawing Sheets

METHOD AND APPARATUS FOR MOUNTING A CURVED PANEL TO A LANDING

BACKGROUND OF THE INVENTION

This invention relates to mounting panels on a surface and more particularly, the invention relates to mounting a curved windshield to a landing on a boat deck, recreational vehicle or automobile.

Systems for mounting curved panels to a landing, and particularly mounting windshields to the deck of a boat are generally known. Such prior systems include mounting an extrusion having an upper, an intermediate and a lower portion. The upper portion includes a receptacle which receives a boat windshield, and the lower portion is at a fixed degree angled relative to the receptacle. The lower portion is mounted directly to the boat deck.

However, when using this system to mount a panel, it is necessary to bend the elongated member to conform to the curvature of the boat deck and the lower edge of the glass. In bending the elongated member, twisting may occur resulting in the lower portion standing up from the deck. This lower portion when bent does not maintain a flush continuous contact with the deck over the full length requiring additional mounting screws. Further, the compound curvature of the elongated member makes it difficult to mount the screws to secure the member to the deck. In addition, even after securing the windshield to the deck, gaps may appear between the bottom portion and the deck.

One solution to solve this mounting problem is disclosed in U.S. Pat. No. 4,750,449 to Muhlberger. This mount includes an elongated extrusion having an upper, intermediate and lower portion connected one to the other. However, the lower portion of this extrusion is curved to maintain a continuous contact with the boat deck. Curving this lower portion results in the extrusion having only minimum contact with the boat deck. Consequently, water or air may leak between the member and the boat deck.

SUMMARY OF THE INVENTION

According to the present invention there is provided a method and apparatus for mounting a curved panel to a landing of a recreational vehicle. The method includes the steps of providing an elongated extrusion having in cross section a side portion coupled at one end to a base portion and coupled at an intermediate location to a leg portion. The side portion extends along a curve on the landing with a varying extrusion profile. The base portion has a flat bottom surface that is securely fastened to the landing. By maintaining a base portion bottom surface flat against the landing along the curve, water and air are prevented from flowing between the extrusion and the landing. The curved panel is fastened to the leg portion of the extrusion using known techniques. By permitting the base portion to bend at different angles relative to the side portion along the curve, the base portion of the extrusion mounts to the landing while maintaining surface-to-surface contact. In addition, this surface-to-surface contact may provide additional surface in contact to more rigidly secure the extrusion and panel to the landing.

DESCRIPTION OF THE PREFERRED EMBODIMENTS

Reference will now be made in detail to a preferred embodiment of the present invention, an example which is illustrated in the accompanying drawings.

Figure 1:
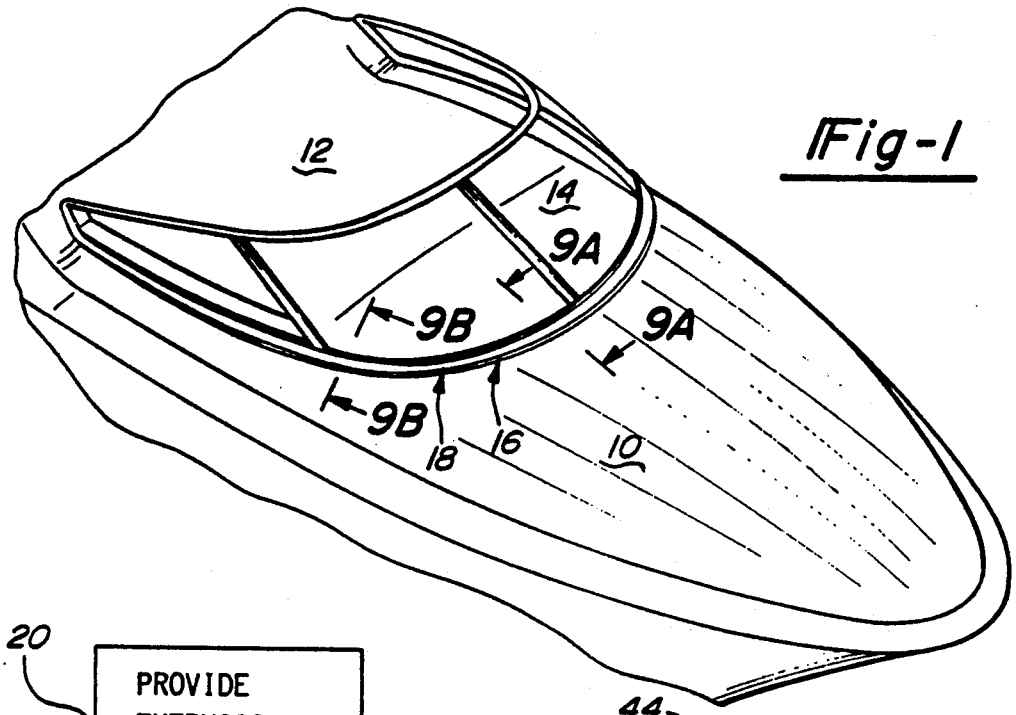
FIG. 1 is a fragmented perspective view of a boat deck illustrating a mounting system for a curved windshield to the landing of the boat constructed in accordance with the present invention.

In FIG. 1 there is illustrated a boat generally designated 10 having a cockpit 12 partially enclosed adjacent its forward end by a curved panel 14. The panel 14 is conventionally formed of materials such as tempered safety glass, acrylics or composites, and it will be appreciated from a review of FIG. 1 in conjunction with FIGS. 9*a* and 9*b*, that the panel, preferably a windshield formed of different angles with a landing 16, of the boat at various longitudinal locations.

Figure 9A:
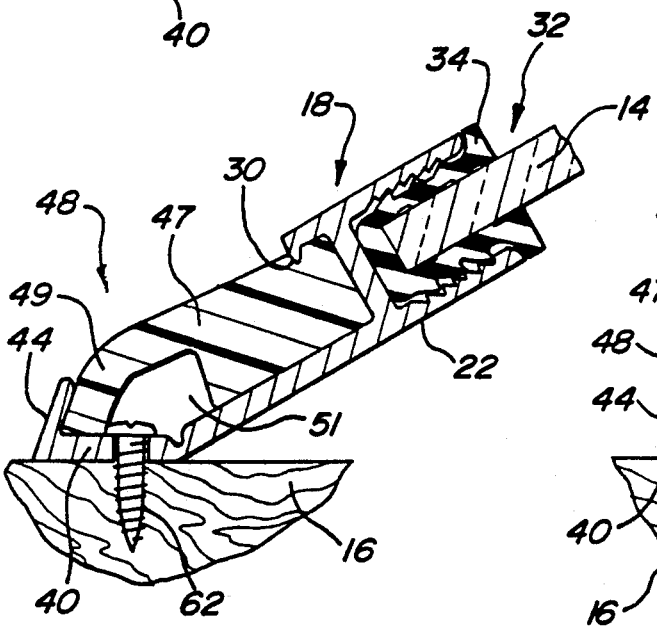
FIGS. 9*a* and 9*b* are enlarged cross sectional views of the extrusion taken along lines 9*a*—9*a* and 9*b*—9*b* in FIG. 1, respectively.
Figure 9B:
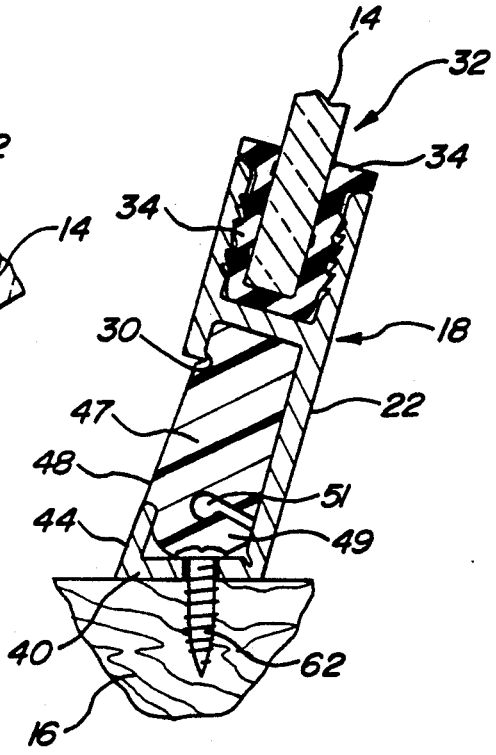

For example, as illustrated by FIG. 9*a*, the forward most portion or extremity of panel 14 along the center line of boat may lie at a relatively horizontal angle, and as illustrated by FIG. 9*b*, the forward most portion of panel 14 along a curved line of landing 16 lies at a more vertical angle. Thus, extrusion 18 must be able to accommodate the bending and twisting necessary to mount the lower curved edge of panel 14. Extrusion 18 is conventionally constructed by using extruding techniques, the extrusion 18 may be constructed using other methods such as roll forming, laminating, casting or molding. It will be appreciated that it is highly desirable to form a panel assembly of unitary construction to facilitate continuous sealing contact with the deck without gaps between the landing 16 and extrusion 18. In accordance with the present invention, these criteria are accommodated with extrusion 18 having varying cross sectional configurations which achieve those purposes.

Figure 2:
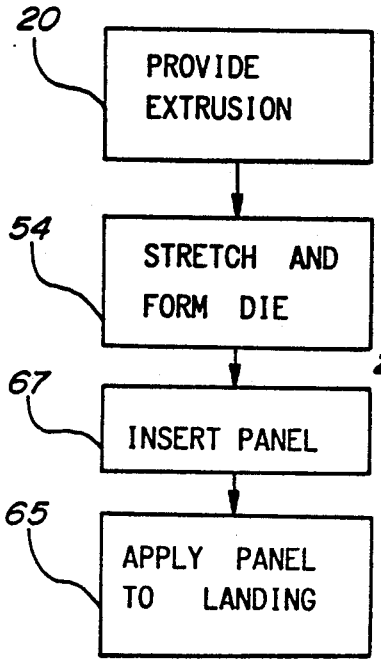
FIG. 2 is a flow diagram illustrating the steps of the process for mounting the panel to the landing of the boat.

Referring to FIG. 2 there is shown a flow diagram illustrating steps in the process for modifying the extrusion so that it can be used to mount a panel to a landing. In step 20, extrusion 18 is provided and illustrated in FIGS. 3*a* and 3*b* having a side portion 22 with an inside surface 26. Coupled about side portion 22 midsection is leg portion 24 which preferably extends perpendicularly away from the inside surface 26. Disposed at the other end of leg portion 24 from side portion 22 is side 28 having a prong 30. Side 28 with leg portion 24 and side portion 22 form a channel 32 which is operative to receive flexible channel gasket 34 (see FIGS. 8). At the end of side portion 22 distal from channel 32 is base portion 40. Disposed in between base portion 40 and side portion 22 is groove 42 which narrows the thickness of side portion 22 to allow base portion 40 to easily bend. Disposed at the other end of base portion 40 from side portion 22 is hook portion 44 which extends inward toward channel 33. Hook portion 44 in conjunction with base portion 40, side portion 22, leg portion 24 and prong 30 are operative to receive flexible trim piece 48 (see FIGS. 9*a* and 9*b*).

Figure 4:
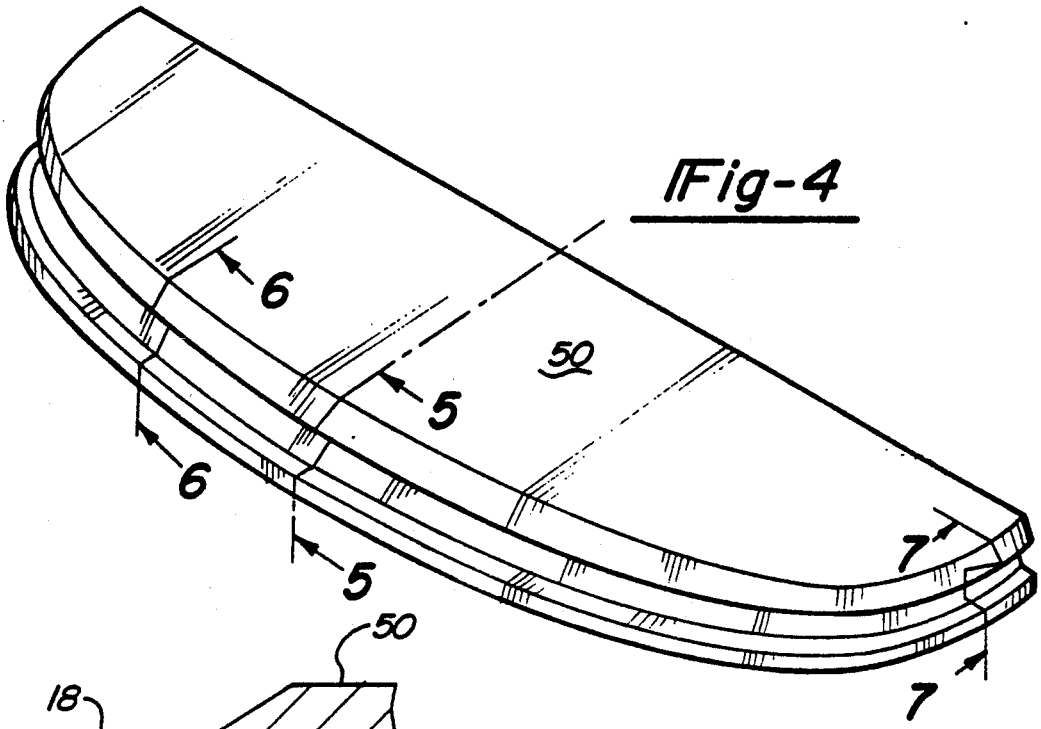
FIG. 4 is a perspective view of the die for shaping the extrusion.

Referring to FIG. 4, a die 50 is formed in a general curvature shape to match the curvature of the panel and base portion so that extrusion 18 can easily mount to boat landing 16.

Figure 3A:
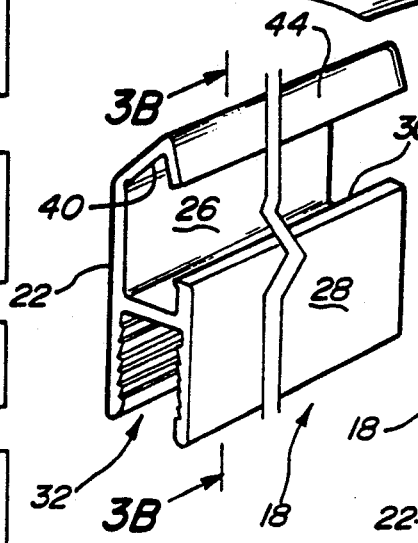
FIG. 3*a* is an perspective view of the extrusion prior to any fabrication techniques.
Figure 3B:
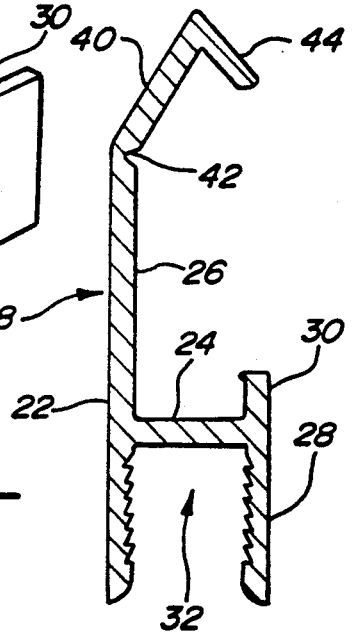
FIG. 3*b* is an enlarged cross sectional view of the extrusion shown in FIG. 3*a;*

Referring to FIG. 2 in step 54, extrusion 18, shown in FIGS. 3*a* and 3*b*, is stretched at its ends using conventional techniques such as a stretch forming machine or other bending apparatuses. Preferably, extrusion 18 is constructed from aluminum, although other materials such as PVC, composites and other metals may be used. While extrusion 18 is stretched, it is formed around die 50. It may also be preferable prior to stretch forming extrusion 18 in the die, that extrusion 18 be preformed using another die to change the relative angle between base 40 and side 22 to provide proper angling of channel 33 along the curve of landing 16.

Figure 5:
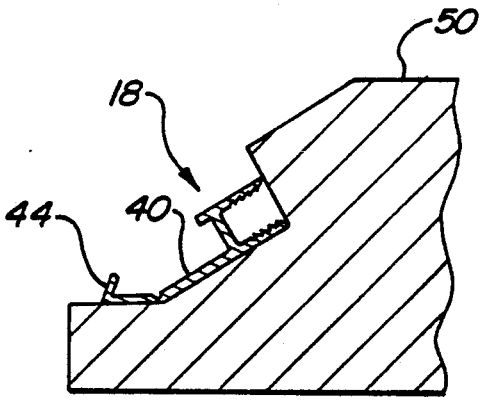
FIGS. 5, 6 and 7 are enlarged cross sectional views of the extrusion and the die taken along lines 5—5, 6—6 and 7—7 in FIG. 4, respectively.
Figure 6:
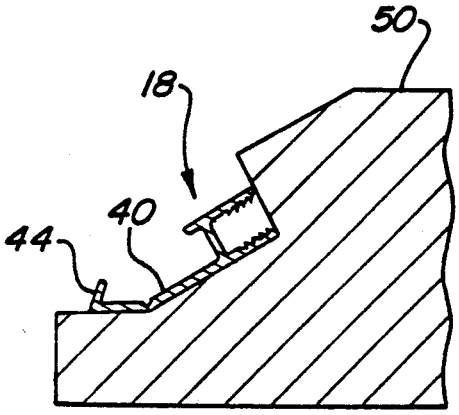
Figure 7:
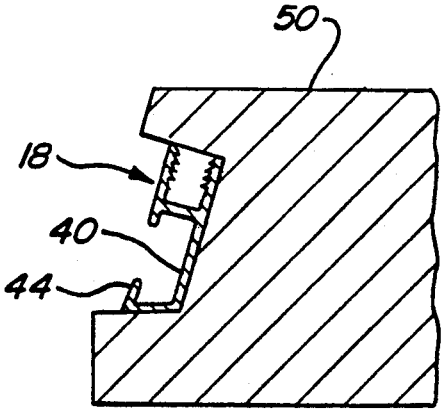

Referring to FIGS. 5–7, die 50 has a trough portion 52 which receives extrusion 18. The shape of trough 52 is selected to vary the angle of base portion 40 with respect to side portion 22 along the curve of extrusion 18. Although extrusion 18 is shown being stretched and formed around a die in step 54, these steps are not required. Extrusion 18, if constructed from a thin or flexible enough material, may be mounted directly to the landing without being stretched and formed. However, when the extrusion is mounted directly to the landing 16, the angle of base portion 40, with respect to side portion 22, will vary along the curvature of landing 16, with respect to side portion 22.

Figure 8:
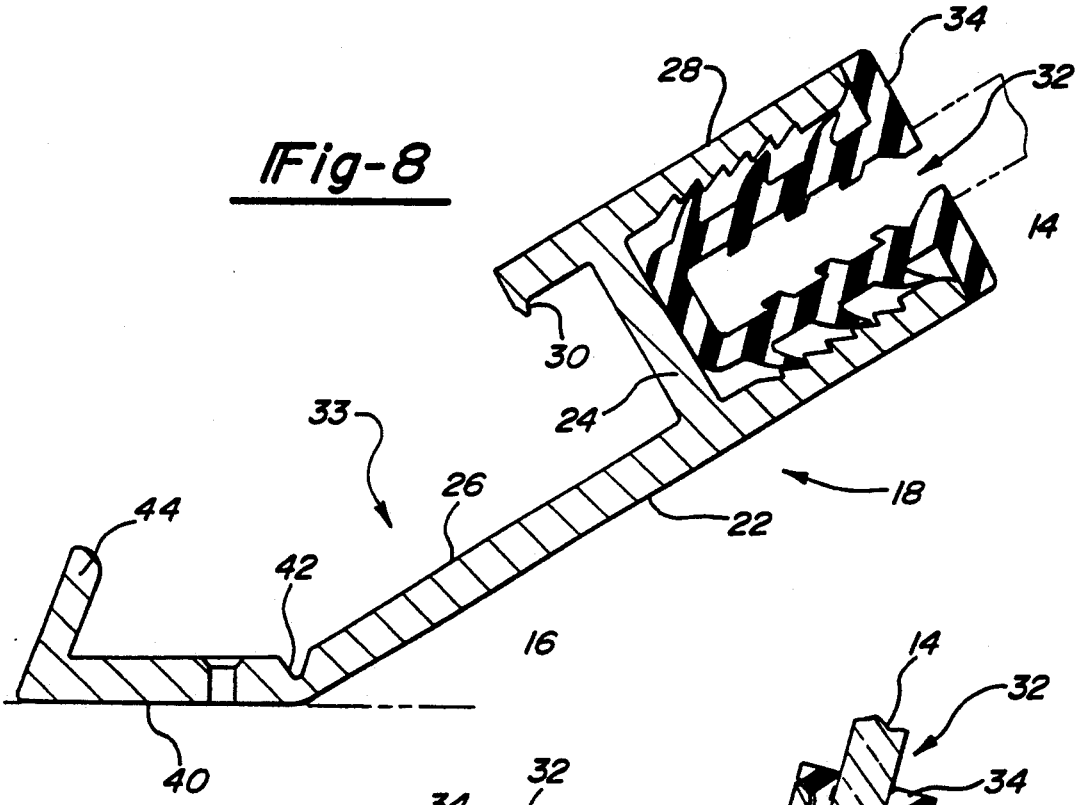
FIG. 8 is a cross sectional view of the extrusion mating with the windshield and gasket.

Referring to FIG. 8, in the next step 61, gasket 34 is attached to the panel and inserted into channel 32 in extrusion 18. These flexible gaskets are conventional and are described in more detail in U.S. Pat. No. 4,750,449 which is hereby incorporated by reference. Panel 14 is then inserted into channel 32 formed in channel gasket 34 and is securely held in place by gasket 34. Then other extrusions (not shown) are connected to the panel 14 and extrusion 18. The gasket could be replaced by other securing devices such as adhesives, or other fastening techniques.

Preferably, once the panel and extrusion have been assembled it is mounted to the landing in step 65. It is securely fastened in step 65 to landing 16. Referring to FIGS. 9*a* and 9*b*, the extrusion is securely fastened to landing 16 with a plurality of fasteners 62, such as a screw, by driving the fastener through base portion 40 into landing 16. Fasteners 62 are preferably spaced at even distances away from each other around location where extrusion 18 meets landing 16.

Referring to FIGS. 9*a* and 9*b*, after the extrusion 18 is secured to the landing, an optional trim piece 48 is attached to the extrusion 18. Trim piece 48 is preferably constructed from a flexible material that will mold into channel 33 formed with hook portion 44, base portion 40, inside portion 26, leg portion 24 and prong 30. Referring to FIGS. 9*a* and 9*b*, trim piece 48 has a solid base portion 47 and leg portion 49. Trim piece 48 when formed in extrusion 18 around the curve, leg portion 49 curls around channel 51 to fill the channel 33 between prong 30 and hook 44.

Referring to FIGS. 9*a* and 9*b*, it is recognized that base portion bends inward or outward with respect to side portion 22 to accommodate panels of different curvature. It is further recognized that base portion 40 lies flat against landing 16 so as to prevent water or air from penetrating the area between extrusion 18 and panel 16. Base portion 40 has a flat bottom surface thereby increasing the surface area in contact with the landing. This increase in surface area creates a more rigid structural mounting.

This concludes the description of the preferred embodiments. A reading by those skilled in the art will bring to mind various changes without departing from the spirit and scope of the invention. It is intended, however, that the invention only be limited by the following appended claims.

What is claimed is:

1. An apparatus for mounting a windshield to a landing comprising:

a landing on a recreational vehicle;

an elongated extrusion having in cross section a side portion connected at one end to a generally planar base portion and coupled at an intermediate location to a leg portion, said extrusion extending along a curve on a landing, said cross section having a reduced thickness between said side and base portion such that said base can be bent with respect to said side with the angle between the base portion and the side portion varying along the curve and with said generally planar base portion remaining flat against said landing;

fasteners for attaching the extrusion to the landing; and a curved panel attached to the leg and side portion of the extrusion.

2. The apparatus as recited in claim 1 further comprising:

a channel formed between said base, side portion and said panel; and an elongated trim piece coupled to said base portion and said side portion, said trim piece extending around an opening to form a channel between said trim piece and said extrusion where the cross section of the opening varies along the curve.

3. The apparatus as recited in claim 1 further comprising:

said leg portion extending substantially perpendicularly away from said side portion;

a second side portion coupled to said leg portion and extending substantially parallel to said side portion;

said side portion, said leg portion and said second side defining a first channel; and said base portion, said side portion, said leg portion and said second side forming a second channel.

4. The apparatus as recited in claim 2 further comprising a gasket mounted between said panel and said first channel.

5. The apparatus as recited in claim 2 further comprising an elongated flexible trim piece disposed in said second channel, said trim piece having a leg portion and a base portion extending around an opening formed between the extrusion and the trim piece.

6. The apparatus as recited in claim 1 wherein said reduced thickness defines a groove formed in said extrusion between said base portion and said side portion to permit said base portion to be easily angled toward said side portion around the curve.

7. An apparatus for mounting a curved windshield to a landing on a boat comprising:

an elongated extrusion with a portion having a radius of curvature and having in cross section a side portion with a base portion connected at one end, said cross section having a reduced thickness between said side and base portion such that said base portion can be bent with respect to said side portion, said base portion having a generally planar surface that engages said landing;

means coupled to said side portion for forming a first channel to receive a boat windshield.

8. The apparatus as recited in claim 7 wherein said reduced thickness defines a groove between the base portion and the side portion to permit said base portion to easily angle away from said side portion.

9. The apparatus as recited in claim 7 further comprising a second channel and a trim piece disposed in said second channel having an opening to form a third channel between said trim piece and said extrusion where the cross sectional area of the opening varies at different locations along the radius of curvature.

10. The apparatus as recited in claim 9 further comprising a hook portion coupled to said base portion for constraining said trim piece in said second channel.

11. The apparatus as recited in claim 9 further comprising a gasket coupled to said side in said first channel having an opening operative to receive the windshield.

* * * * *